United States Patent [19]

Matsuda et al.

[11] 4,395,483

[45] Jul. 26, 1983

[54] DIRECT POSITIVE TYPE SILVER HALIDE PHOTOSENSITIVE MATERIAL

[75] Inventors: Terumi Matsuda; Shoji Ishiguro; Shigenori Moriuchi; Yoshiaki Suzuki, all of Minami-ashigara, Japan

[73] Assignee: Fuji Photo Film Co., Ltd., Kanagawa, Japan

[21] Appl. No.: 352,928

[22] Filed: Feb. 26, 1982

Related U.S. Application Data

[63] Continuation of Ser. No. 142,954, Apr. 23, 1980, abandoned.

[30] Foreign Application Priority Data

Apr. 27, 1979 [JP] Japan ..... 54-52115

[51] Int. Cl.[3] ..... G03C 5/24; G03C 1/36

[52] U.S. Cl. ..... 430/411; 430/567; 430/596; 430/597; 430/412; 430/936

[58] Field of Search ..... 430/596, 411, 412, 936, 430/567, 597

[56] References Cited

U.S. PATENT DOCUMENTS

| | | | |
|---|---|---|---|
| 2,717,833 | 9/1955 | Wark | 430/596 |
| 3,501,307 | 3/1970 | Illingsworth | 430/567 |
| 3,656,961 | 4/1972 | Chang | 430/612 |
| 3,862,842 | 1/1975 | Bissonette | 430/936 |
| 4,084,969 | 4/1978 | Nakamura et al. | 430/936 |

*Primary Examiner*—Won H. Louie, Jr.
*Attorney, Agent, or Firm*—Sughrue, Mion, Zinn, Macpeak and Seas

[57] ABSTRACT

A high contrast, chemically fogged direct positive type silver halide photosensitive material is described containing at least one ammine complex salt selected from those including cobalt, nickel, ruthenium or chromium, by which the contrast in the lower optical density region is improved while retaining superior Dmax and sensitivity.

17 Claims, 2 Drawing Figures

DIRECT POSITIVE TYPE SILVER HALIDE PHOTOSENSITIVE MATERIAL

This is a continuation of application Ser. No. 142,954, filed Apr. 23, 1980, now abandoned.

BACKGROUND OF THE INVENTION

1. Field of the Invention

The present invention relates to a direct positive type silver halide photosensitive material containing chemically fogged silver halide grains and more particularly it relates to a high contrast, direct positive type silver halide photosensitive material having good sensitivity and Dmax, and an improved toe gradient of the characteristic curve.

2. Description of the Prior Art

Direct positive type photosensitive materials utilizing direct positive type silver halide photographic emulsions are advantageous for rapidly and easily obtaining positive images from the originals because they give positive images directly by a single developing process. Direct positive type photosensitive materials are thus widely used for duplication of printing plates, drawings, etc. However, in spite of various endeavors for technical improvements, they still have certain disadvantages, as discussed below.

In producing a direct positive type silver halide photosensitive material, especially a high contrast photosensitive material, when it is attempted to achieve an adequate maximum optical density (Dmax), the gradation in the lower density region (especially where the optical density is less than 1.5) is apt to be low gradient (soft; these are interchangeably used herein in an analogous sense to the use of the term "soft" in *The Theory of the Photographic Process,* 4th Ed., James, T. H., Ed., 1977, p. 510), thus resulting in inadequate contrast in (poor clearness of; these expressions are interchangeably used herein) the highlight portions. Such photosensitive materials having inadequate contrast in the highlight portions due to the soft gradation in the region of lower optical density are referred to as the photosensitive materials having an undesirable soft toe gradient of the characteristic curve.

In direct positive type light-sensitive materials, fogged nuclei which were formed prior to exposure on the surfaces of silver halide grains are bleached (i.e., oxidized) in the course of the exposure to light, and, upon treatment with a developing solution, the silver halide in the exposed portions is not developed, while the unexposed silver halide is developed. Thus positive images are formed. The fogged nuclei can be formed by the use of a reducing agent and a gold salt, in combination, as disclosed in British Pat. No. 723,019. If it is desired to achieve a sufficiently stable and high Dmax in this type of light-sensitive material, strongly fogged nuclei must be formed over the entire surface of the silver halide grains contained in the emulsions of the light-sensitive materials. When fogged nuclei are formed to meet such a requirement for achieving a sufficiently stable high Dmax, unavoidably some silver halide is formed having excessively fogged nuclei that cannot be bleached (oxidized) during the course of light exposure. As a result, this typical approach in attempting to achieve a high Dmax unavoidably provides direct positive photosensitive materials having low sensitivity and poor contrast in the highlight areas of the image.

The toe gradient in the characteristic curve of the direct positive type silver halide photosensitive emulsion relates to the gradient in the lower density region of the curve (for example, in the region of density of from about 0.1 to 1.0, and especially in the region of density of from 0.1 to 0.5), as is shown in FIG. 1. Therein the curve A shows a characteristic curve having a desirable hard toe gradient and the curve B shows a characteristic curve having an undesirable soft toe gradient.

It is of great concern among those skilled in the art to obtain direct positive type photosensitive materials having an enhanced Dmax and an improved contrast in the highlight portions. The photosensitive material can be evaluated for this by taking the absolute value of the difference between the log E's at D=1.5 and at D=0.1, with the larger value indicating inferior contrast in the highlight portions.

U.S. Pat. No. 3,862,842, issued to Bissonette, relates to amplification of dye images formed utilizing a redox reaction in which metal complex salts are employed as oxidants to act upon conversion of silver images to dye images. In other words, the metal complex salts must necessarily be removed after the silver images are formed as is discussed infra in more detail. Where the metal complex salts are added prior to formation of silver images, a dye image-amplifying effect is not obtained.

SUMMARY OF THE INVENTION

The object of the present invention is to provide a high contrast direct positive type silver halide photosensitive material having a desirable sharp toe gradient in the characteristic curve thereof, as well as high sensitivity and a high Dmax.

It has now been discovered that the aforementioned drawbacks can be eliminated by using a particular direct positive type photosensitive silver halide material, namely, a high contrast direct positive type silver halide photosensitive material containing at least one metal ammine complex salt wherein the metal component is selected from the group consisting of cobalt, nickel, ruthenium and chromium.

In the present invention, the "toe gradient of the characteristic curve" is evaluated based on the toe gradient value, i.e., the value of the difference between the log E value at density=1.5 and the log E value at density=0.1. Referring to FIG. 2, the method of determining this value is illustrated. A lower absolute value thereof indicates a desirable hard toe gradient for the characteristic curve.

In contrast to the prior art as discussed above, in the present invention metal complex salts as described below act at the time of formation of silver images. Thus it is apparent from the mechanism of the development of direct positive type photosensitive materials that the incorporation of the metal complex salts into photosensitive materials of this type at a later stage (e.g., at the time converting the silver images of dye images, as is contemplated in Bissonette) could not provide the effects desired according to this invention.

DETAILED DESCRIPTION OF THE INVENTION

Figure 1:
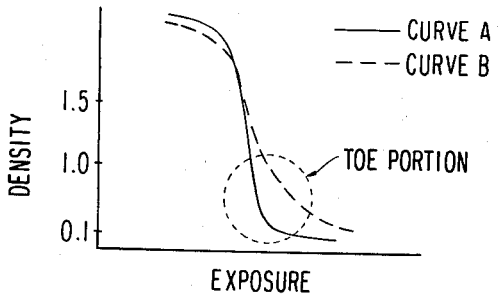
Figure 2:
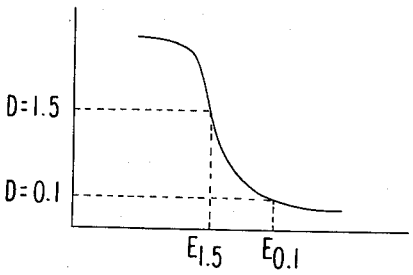

The cobalt, nickel, ruthenium and chromium metal ammine complex salts used in the present invention are inert metal complex salts which are relatively stable (slow) with respect to the ligand exchange reaction.

From the viewpoint of stability of the metal complexes, valence states of $Co^{3+}$, $Cr^{3+}$, $N^{2+}$, and $Ru^{3+}$ are preferred.

The ligands of said metal complex salts necessarily incorporate the ammine ($NH_3$) ligand (1 to 6 ammine ligands), but in addition to the ammine ligand, chloride, nitrate, water and carbonate ligands can also be employed.

Especially useful among such metal complex salts are those having from 4 to 6 ammine groups; some particularly preferred complex salts are illustrated by the following formulae:

$[Co(NH_3)_5H_2O]X$; $[Co(NH_3)_5CO_3]X$; $[Co(NH_3)_5Cl]X$; $[Co(NH_3)_4(OCOO)]X$; $[Co(NH_3)_5(NO_2)]X$; $[Co(NH_3)_6]X$;

$[Ni(NH_3)_6]X$; $[Cr(NH_3)_5(H_2O)]X$; $[Cr(NH_3)_5Cl]X$; and $[Ru(NH_3)_6]X$ wherein X represents one or more anions. The number of said anions are determined by the charge neutralization rule.

Among the above metal complex salts, cobalt ammine complex salts, especially the pentaammine and hexaammine complex salts thereof, have a remarkable effect on the toe gradient of the characteristic curve.

The direct positive type silver halide photosensitive material used in accordance with the present invention is that which does not form a color dye image, but rather forms a silver image. That is, the direct positive type photosensitive material according to this invention is different from the type of material disclosed in U.S. Pat. No. 3,862,842 issued to Bissonette, wherein the substitution metal complexes, such as Co complexes, are employed as oxidants in the course of a redox reaction in which silver images are converted into dye images. Rather, this invention is directed to direct positive type materials for forming silver images having high contrast (i.e., excellent clearness) in the highlight portions, in which the metal complex salts act on strongly fogged nuclei when the fogged nuclei are bleached upon exposure to light. Thus in the present invention, the metal complex salts must participate in formation of silver images; otherwise, the toe gradation improvement being not attained.

The direct positive type silver halide emulsion used in the direct positive type silver halide photosensitive material in accordance with the present invention is a photographic emulsion containing chemically fogged silver halide grains and the emulsion of this type is well known, for example, in Japanese Patent Application (OPI) No. 6918/74 (the term "OPI" as used herein refers to a "published unexamined Japanese patent application").

Direct positive type silver halide photographic emulsions can be roughly classified into two types: (1) wherein the emulsion has free electron trapping nuclei inside the silver halide grains and the grain surfaces are chemically fogged; and (2) wherein the emulsion has substantially no free electron trapping nuclei inside the silver halide grains and has the grain surface chemically fogged.

Emulsions of type (2) are barely capable of giving a direct positive image without the aid of a sensitizing organic dye. Generally, in such a case, the emulsion will not give a direct positive image until the free electrons have been captured by electron acceptors adsorbed onto the grain surface. An emulsion of this type is superior with respect to the contrast of the highlight portions. Furthermore, it generally has superior shelf life when compared to emulsions of type (1). However, special considerations are required with respect to the sensitizing organic dye which must be added to the emulsion in order to render it more sensitive.

Methods of producing the emulsions of type (2) are well known, and described, for example, in U.S. Pat. Nos. 3,501,305, 3,501,306, 3,501,307, etc.

The photosensitive material of the present invention is preferably used in photographic emulsions of type (2), although it can also be used in type (1) emulsions. The emulsions of types (1) and (2) can be distinguished by the method described in Japanese Patent Application (OPI) No. 6198/74, particularly at page 3 (wherein types (1) and (2) correspond to Emulsion Types A and B, respectively).

The photographic emulsion used in the present invention can employ silver chloride, silver bromochloride, silver iodobromochloride, or silver bromoiodide (and mixtures thereof) as the silver halide, with the former three being preferred. A preferred silver halide contains at least 40 mol% silver chloride.

In the present invention, the direct positive image may be obtained by exposure to normal radiation and conventional monochromatic developing.

The photographic emulsion employed in the present invention is not the so-called negative type silver halide photographic emulsion. Agents for providing a desirable toe gradient in a negative type photographic emulsion, disclosed, for example, in Japanese Patent Application (OPI) No. 90120/74 are not necessarily useful in direct positive type photographic emulsions. For example, it is noted that cadmium salts have the effect of reducing the Dmax of direct positive type emulsions, and that polyalkylene oxide compounds often employed as such agents in negative type emulsions have substantially no such effect in direct positive type emulsion in accordance with the present invention.

While direct positive type silver halide photosensitive material in accordance with the present invention is useful as a photosensitive material for any method of obtaining a direct positive image, it is most suitable as a photographic material for printing plates, microphotography, line facsimile, etc., which require a high contrast in the toe gradient portion of the characteristic curve.

The sensitizing organic dyes to be used in the present invention include organic dyes having a sensitizing effect when incorporated in a chemically fogged direct positive type silver halide emulsion. Examples of such dyes are organic dyes selected from halogen acceptors and electron acceptors as described below.

For a silver halide emulsion containing 40 mol% or more silver chloride for use in the present invention, an electron acceptor is preferably employed as the sensitizing organic dye. In the present invention, the electron acceptors having $E_{red}$ of at least $-0.1$ are used.

Typical examples of the organic dyes which may be employed in photosensitive materials according to the present invention are illustrated below by compounds according to formulae (I) through (VII), as follows:

(I)

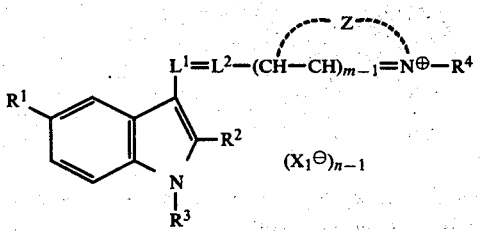

In this formula, $R^1$ represents a hydrogen atom or a nitro group; $R^2$ is selected from a hydrogen atom, lower alkyl groups(alkyl groups having up to 6 carbon atoms, such as methyl, ethyl, etc.), a chlorine atom, a carboxyl group, lower alkoxycarbonyl groups (e.g., methoxycarbonyl, ethoxycarbonyl, butoxycarbonyl, etc.) and aryl groups (e.g., phenyl, etc.); $R^3$ is selected from a hydrogen atom, alkyl groups (e.g., methyl, etc.), substituted alkyl groups [e.g., acetoxyalkyl groups (such as acetoxyethyl, etc.), carboxyalkyl groups (such as carboxyethyl, etc.), sulfoalkyl groups (such as sulfobutyl, etc.), aralkyl groups (such as benzyl, etc.) and the like] and aryl groups (e.g., phenyl, p-toluyl, etc.); $R^4$ is selected from alkyl groups (e.g., methyl, ethyl, etc.), substituted alkyl groups [e.g., hydroxyalkyl groups (such as 2-hydroxyethyl, etc.), sulfoalkyl groups (such as 3-sulfopropyl, etc.), carboxyalkyl groups (such as 4-carboxybutyl, etc.), aralkyl groups (such as phenethyl, benzyl, etc.), vinylmethyl group and the like] and aryl groups (e.g., phenyl, etc.); $L^1$ and $L^2$ each represents a methine chain (e.g., methine, methyl substituted methine, phenyl substituted methine, etc.), or $L^2$ and $R^4$ together can form a polymethine chain; $X_1$ represents an anion (e.g., bromide ion, p-toluenesulfonic acid ion, perchloric acid ion, etc.); m and n each represents 1 or 2; and Z represents an atomic group forming a 5-membered or 6-membered heterocyclic nucleus (such as oxazoline, oxazole, benzoxazole, naphthoxazole, thiazoline, thiazole, benzothiazole, naphthothiazole, selenazole, benzoselenazole, naphthoselenazole, 2-pyridine, 4-pyridine, 2-quinoline, 4-quinoline, benzimidazole, indolenine, 3,3'-dialkylindolenine, imidazo[4,5-d]quinoxaline, indole nucleus or the like, the nucleus being optionally substituted with alkyl, aryl, hydroxyl, alkoxy, aryloxycarbonyl, nitro, halogen, etc.).

(II)

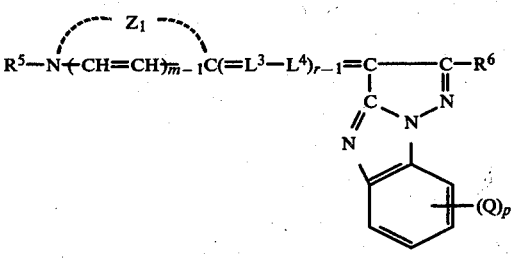

(III)

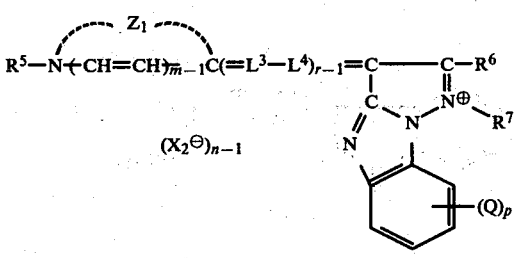

In formulae (II) and (III) m represents 1 or 2; n represents 1 or 2; r represents 1, 2 or 3; p represents 1, 2, 3 or 4; $L^3$ and $L^4$ each represents a methine chain, or $L^3$ and $R^5$ can together form a polymethylene chain; $R^5$ and $R^7$ are each selected from alkyl groups (e.g., methyl, isopropyl, n-pentyl, etc.), substituted alkyl groups [e.g., hydroxyalkyl groups (such as 2-hydroxyethyl, etc.), acetoxyalkyl groups (such as 3-acetoxypropyl, etc.), alkoxyalkyl groups (such as 2-methoxyethyl, etc.), carboxyalkyl groups (such as 4-carboxybutyl, etc.), sulfoalkyl groups (such as 2-sulfoethyl, etc.), alkoxycarbonylalkyl groups (such as 3-ethoxycarbonylpropyl, etc.), aralkyl groups (such as benzyl, phenethyl, etc.), and the like] and a vinylmethyl group; $R^6$ represents a substituent common in the pyrazolo[1,5-a]benzimidazole compounds, such as a hydrogen atom, an alkyl group, a carboxyl group, an alkoxycarbonyl group, an amino group, an acylamino group, an aryl group, an acid amino group, etc.; $Z^1$ represents an atomic group forming a 5-membered or 6-membered heterocyclic nucleus and is the same as Z in the formula (I) (such as 4,5-diphenylthiazole, 5-nitrobenzothiazole, 5-methylbenzothiazole, 5-methoxycarbonylbenzothiazole, 6-nitrobenzothiazole, 5-iodobenzothiazole, 6-phenylbenzothiazole, tetrahydrobenzothiazole, α-naphthothiazole, β,β'-naphthothiazole, benzoxazole, 5,6-dimethylbenzoxazole, naphthoxazole, 3,3-dimethyl-5-nitroindolenine, 6-nitro-2-quinoline, 6-nitro-4-quinoline, 4-methylthiazoline, 5,6-dichlorobenzimidazole, 1,3-diethylimidazo[4,5-b]quinoxaline, 1,3-diallylimida[4,5-b]quinoxaline, 1,3-diphenylimidazo[4,5-b]quinoxaline nucleus or the like); Q represents known substituent in the pyrazolo[1,5-a]benzimidazole compounds, such as a halogen atom, a lower alkyl group (e.g., methyl, ethyl, etc.), an alkoxy group (e.g., methoxy, ethoxy, etc.), an aryl group (e.g., phenyl, etc.), a carboxyl group, an alkoxycarbonyl group, an acylamino group (e.g., acetylamino, etc.) or the like; and $X_2$ represents an anion as defined for $X_1$.

(IV)

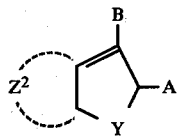

wherein $R^2$ represents an atomic group forming a cycloheptatriene ring; Y represents an oxygen atom, —NH— or —N=; A represents =O, a halogen atom or a pyridinium group; and B represents a hydrogen atom or an alkoxycarbonyl group (e.g., methoxycarbonyl, ethoxycarbonyl, etc.) or

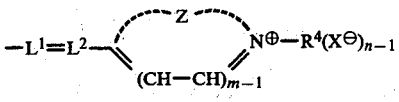

wherein $L^1$, $L^2$, Z, $R^4$, n, m and $X_1$ are as defined in the formula (I). Such compounds are described in Japanese Patent Application No. 91238/69.

(V)

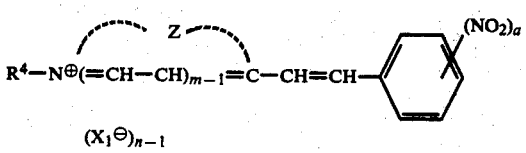

(VI)

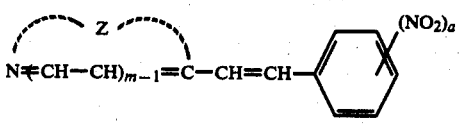

wherein Z, $R^4$, m, n and $X_1$ are as defined in the formula (I), and a represents 1 or 2. Such compounds are described in West German Patent Application (OLS) No. 1,935,311.

(VII)

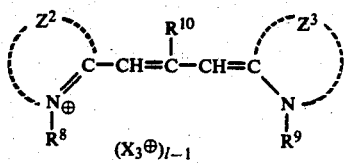

wherein $Z^2$ and $Z^3$ may be the same or different and each represents an indolenine nucleus (preferably substituted with a nitro group), a benzoxazole nucleus (preferably substituted with a nitro group) or a naphthoxazole nucleus; $R^8$ and $R^9$ may be the same or different and each represents a group as defined for $R^5$ in the formula (II); $R^{10}$ represents a hydrogen atom or a lower alkyl group (preferably methyl or ethyl); and $X_3$ and l are as defined for $X_1$ and n in the formula (I), respectively.

Dyes according to formula (I) are described in Japanese Patent Application (OPI) No. 71223/73, and dyes according to formulae (I), (II), (III), (IV), (V) and (VI) are described in U.S. Pat. Nos. 3,854,953, 3,816,121 and 3,790,388.

Examples of the sensitizing organic dyes used in the present invention are shown below, but are not limited thereto:

(A)

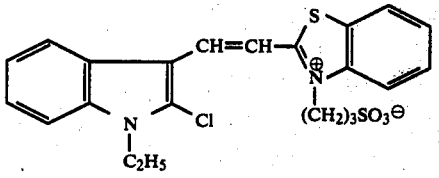

(B)

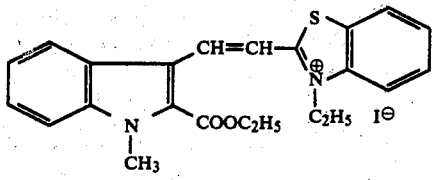

(C)

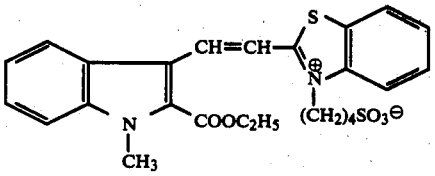

(D)

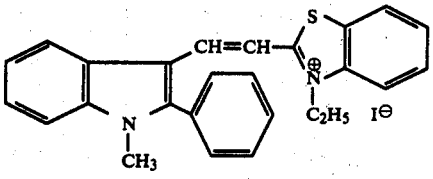

(E)

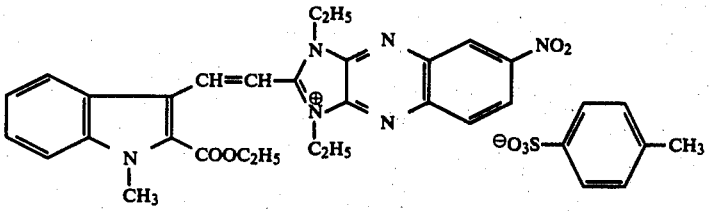

(F)

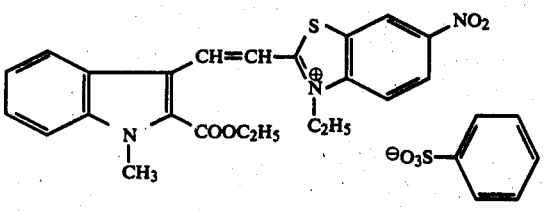

(G)

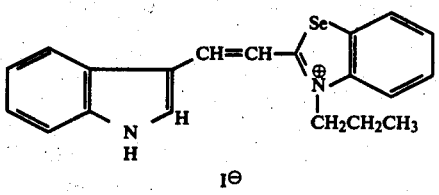

-continued (H)

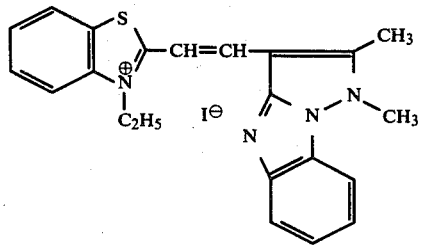

(I)

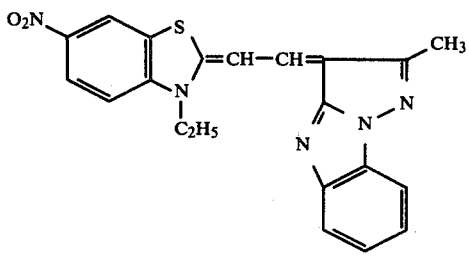

(J)

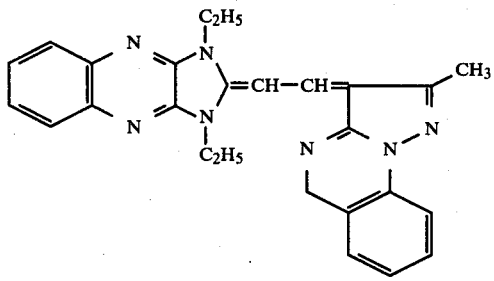

(K)

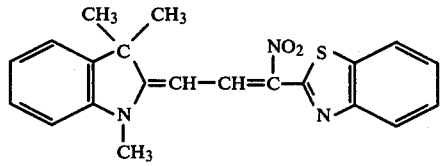

(L)

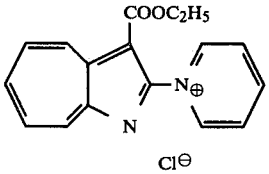

(M)

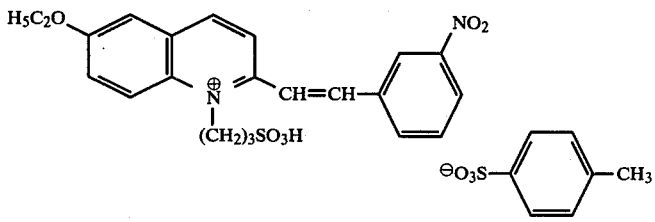

(N)

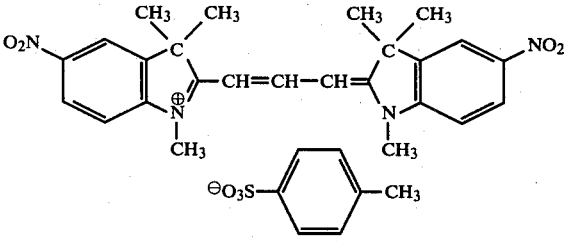

(O)

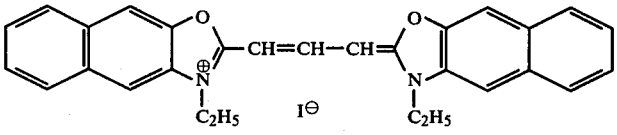

In addition, the "electron acceptors" described in U.S. Pat. No. 3,816,121 and the "halogen acceptors" described in U.S. Pat. No. 3,854,953 may also be employed. It is preferred in the present invention to employ a halogen acceptor in combination with an electron acceptor.

The $E_{red}$ value is determined by measuring in an acetonitrile solution containing tetra-n-propylammonium perchlorate as a supporting electrolyte at 25° C. using a mercury dropping electrode and a saturated calomel electrode (SCE) as a reference electrode. More particularly, the value is determined in an acetonitrile solution of $1\times10^{-4}$ mol to $1\times10^{-6}$ mol per liter. The $E_{ox}$ value is determined by the voltammetry similar to the case of the $E_{red}$ using a rotary platinum electrode as an anode and sodium perchlorate as a supporting electrolyte.

By incorporating a metal ammine complex salt according to the present invention in a direct positive type silver halide photosensitive material, the hardness of the toe gradient portion of the characteristic curve is improved, i.e., the contrast of the lower optical density region ($D<1.5$) of the characteristic curve is increased without causing a reductions in Dmax and sensitivity.

The aforementioned metal ammine complex salt used in the present invention is preferably added to a silver halide emulsion layer, but is may also be added to a hydrophilic colloid layer containing no silver halide (e.g., a protective layer).

Although the metal ammine complex salt used in the present invention may be added to a silver halide emulsion containing at least 40 mol% silver chloride during or before the fogging step (but after the silver halide formation) (to improve the hardness of the toe gradient), since this can cause a reduction in Dmax, it is preferred to add the metal ammine complex salt subsequent to the fogging step. The amount of the metal ammine complex salt added may vary depending on the nature of the emulsion, for example, the halogen composition, the particle size, and especially the mode of fogging or the chemical sensitization, and is preferably employed in an amount from about $10^{-5}$ to $10^{-2}$ mol, and more preferably in an amount from $10^{-4}$ to $10^{-3}$ mol, per mol of silver halide.

After the fogging step, bromide ion or iodide ion may be added to the silver halide photographic emulsion used in the present invention in order to further improve contrast (clearness) in the highlight portions. The average particle size of the emulsion is generally from about 0.04 to 2.0 microns in diameter, with particles in the range of from 0.15 to 0.70 micron in diameter being more preferred. The particles preferably have a regular cubic crystal structure with a (100) plane.

Fogged silver halide nuclei in accordance with the present invention are formed by employing an inorganic reducing compound, such as stannous chloride, boron hydride, etc., or an organic reducing compound, such as a hydrazine derivative (e.g., hydrazine), formalin, thiourea dioxide, a polyamino compound, methyldichlorosilane, or the like, optionally combined with a gold salt or a halide ion. Specific examples are described in U.S. Pat. Nos. 2,497,875, 2,588,982, 3,023,102 and 3,367,778, British Pat. Nos. 707,704, 723,019, 821,251 and 1,097,999, French Pat. Nos. 1,513,840, 1,518,095, 739,755, 1,498,213, 1,518,094, 1,520,822 and 1,520,824, Belgian Pat. Nos. 768,563 and 720,660, Japanese Pat. No. 13488/68. It is preferred to form the fogged nuclei by employing a hydrazine derivative in combination with a gold salt.

The sensitizing organic dye used in accordance with the present invention is preferably employed in an amount of from about $1\times10^{-6}$ to $5\times10^{-3}$ mol per mol of silver halide. The dye may be added to the emulsion by dissolving it in water or a water-miscible solvent, such as methanol, ethanol, methyl cellosolve or pyridine. Alternatively, methods of incorporation commonly employed for the spectral sensitization of negative type emulsions may also be employed. See, for example, Japanese patent application No. 8231/70, Japanese Pat. Nos. 23389/69, 27555/69 and 22948/69, U.S. Pat. Nos. 3,485,634, 3,342,605 and 2,912,343 and West German patent application (OLS) No. 1,947,935.

A finished emulsion prepared using a photosensitive material according to the present invention can be coated on any photographic support. For example, it can be coated on a cellulose triacetate film, a polyester film, baryta paper, paper coated with a polyolefin, synthetic paper, a glass plate, etc. The coating can be either of a monolayer or of a multilayered constitution. An antihalation layer may be formed either under the emulsion layer or on the back side of the film. The finished emulsion may further contain other components, such as stabilizers, hardening agents, other dyes, development accelerators, development inhibitors, surfactants, plasticizers, etc., but does not contain a color coupler.

An emulsion prepared using a photosensitive material according to the present invention can utilize gelatin as a protective colloid, with inert gelatin being preferred. In place of gelatin, inert gelatin derivatives and hydrophilic synthetic polymers, such as polyvinyl acrylate, polyvinyl alcohol, polyvinyl pyrrolidone, and polyvinyl methacrylate copolymers can also be employed.

Conventionally known photographic processing methods can be used to develop images formed using the photosensitive material in accordance with the present invention, such as a process involving the sequential steps of exposing, developing, fixing, washing, and drying. The processing solution may be chosen from known compositions. The processing temperature is generally selected between 18° C. and 50° C., although temperatures below 18° C. or above 50° C. may also be applicable. Any developing process which forms a silver image according to the purpose (i.e., monochromatically photographic process) may be employed.

The developing solution may contain a known developing agent. Examples of useful developing agents are dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, heterocyclic compounds obtained by the condensation of a 1,2,3,4-tetrahydroquinoline and an indolene ring as disclosed in U.S. Pat. No. 4,067,872, etc. They may be used alone or in combination. The developing solution may further contain known additives, such as a preservative, an alkaline agent, a pH buffer, an antifogging agent, etc., and, if necessary, may also contain a dissolving aid, a toner, a development accelerator, a surfactant, an anti-foaming agent, a water softening agent, a viscosity imparting agent, etc.

The so-called "Lith type" photographic process may be applied to the photographic emulsion in accordance with the present invention. The "Lith type" developing process refers to a developing process which is carried out infectiously in the presence of a low concentration of sulfite ions, utilizing a dihydroxybenzene compound as a developing agent for the photographic reproduction of line images or halftone images with dots (for more details, see *Photographic Processing Chemistry,* by Mason, 1966, pp. 163–165).

A method in which a developing agent is incorporated in a photosensitive element, for example, in the emulsion layer, and the photosensitive element is treated in an aqueous alkali solution for development can also be used. Among the developing agents that can be used, those which are hydrophobic may be incorporated in the emulsion layer as a latex dispersion, as disclosed in *Research Disclosure,* No. 169 RD-16928. Such a developing process may be combined with a silver salt stabilization process utilizing a thiocyanic acid salt.

The fixing solution may be chosen from commonly employed fixing compositions.

As the fixing agent, organic sulfur compounds known to possess an effect as a fixing agent may be used, as well as thiosulfuric acid salts, thiocyanic acid salts, etc.

A fixing solution may also contain a water-soluble aluminum salt as a hardening agent.

The present invention will be more particularly illustrated in the following examples.

EXAMPLE 1

| | |
|---|---|
| Solution I | |
| $H_2O$ | 800 cc |
| Gelatin | 15 g |
| KBr | 1 g |
| Solution II | |
| $AgNO_3$ | 240 g |
| $H_2O$ added to achieve volume of | 1,400 cc |
| Solution III | |
| KBr | 45 g |
| NaCl | 67 g |
| $H_2O$ added to achieve volume of | 1,300 cc |

Solutions II and III were concurrently added to Solution I, kept at 65° C., to prepare a silver bromochloride emulsion containing cubic grains having an average particle size of 0.35 micron. The emulsion was desalted and then chemically fogged by adding 90 g of gelatin and treating with hydrazine and a gold salt. To the thus fogged emulsion. Dyes (H) and (M) as noted above were added to prepare an emulsion, which was then coated on a polyethylene terephthalate film support in an amount, as silver, of 4 g/m$^2$ (hereinafter "g Ag/m$^2$").

Each of the following ammine complex salts, viz., $[Co(NH_3)_6]Cl_3$; $[Co(NH_3)_5Cl]Cl_2$; $[Co(NH_3)_5(NO_2)]Cl_2$; and $[Co(NH_3)_5(CO_3)](NO_3)_2.H_2O$ was added to the emulsion obtained above in an amount of $10^{-3}$ mol per mol of silver in the emulsion to obtain each emulsion, and each sample was then coated on a polyethylene terephthalate film support in an amount of 4 g Ag/m$^2$.

Each of the coated samples obtained above was cut into strips and exposed to the light, through an optical wedge, of a tungsten lamp of 2854° K. The strips were then developed in the developing solution having the composition shown below, at 20° C. for 3 minutes, and were then measured on a Densitometer Model S, manufactured by Fuji Photo Film Co., Ltd. to obtain characteristic curves, respectively. The results are given in Table 1.

| Composition of the developing solution: | |
|---|---|
| Water (at about 50° C.) | 500 cc |
| p-Methylaminophenol sulfate | 3 g |
| Sodium silfite anhydride | 45 g |
| Hydroquinone | 12 g |
| Sodium carbonate monohydrate | 80 g |
| Potassium bromide | 2 g |
| Water to make | 1,000 cc |

The above developing solution was then diluted with water to 1:1 for use.

TABLE 1

| Sample No. | Ammine Complex Salt Added before Coating ($10^{-3}$ mol/mol Ag) | Relative Sensitivity | Toe Gradient Value (a) | Toe Gradient Value (b) | Relative Evaluation Value of Toe Gradient (c) | $D_{max}$ |
|---|---|---|---|---|---|---|
| 1 | None (control) | 100 | −0.48 | 3.02 | 100 | 4.10 |
| 2 | $[Co(NH_3)_6]Cl_3$ | 126 | −0.35 | 2.24 | 135 | 4.35 |
| 3 | $[Co(NH_3)_5Cl]Cl_2$ | 158 | −0.35 | 2.24 | 135 | 4.10 |
| 4 | $[Co(NH_3)_5(NO_2)]Cl_2$ | 141 | −0.35 | 2.24 | 135 | 4.00 |
| 5 | $[Co(NH_3)_5(OCOO)](NO_3)_2.H_2O$ | 150 | −0.35 | 2.24 | 135 | 4.10 |

Note:
Relative Sensitivity: Sensitivity at D = 1.5 and shown as relative value using the sensitivity of No. 1 as 100, i.e., a greater value means greater sensitivity.
Toe Gradient Value (a) = $\log E_{at\ D=1.5} - \log E_{at\ D=0.1}$ The smaller absolute values indicate a better toe gradient.
Toe Gradient Value (b) = $10^{|a|}$ This value shows what times of exposure amount based on the exposure amount at D = 1.5 is necessary to give the same exposure amount at D = 0.1. The smaller values indicate a better toe gradient.
Relative Evaluation Value of Toe Gradient: Reciprocal of each toe gradient value (b) and shown as a relative value using the value (c) of No. 1 as 100. The greater values indicate a better toe gradient.
$D_{max}$: Optical density in the unexposed area.

From the results of Table 1 it can be understood that when the metal ammine complex salts used in the present invention were incorporated, a desirable improvement in the toe gradient was obtained.

EXAMPLE 2

Each of the following ammine complex salts, viz., $[Ni(NH_3)_6]Cl_2.\frac{1}{2}H_2O$; $[Cr(NH_3)_5(H_2O)](NO_3)_3$; $[Cr(NH_3)_5Cl]Cl_2$ and $[Ru(NH_3)_6]Cl_3$ was added to a sample of the emulsion containing Dyes (H) and (M) prepared in Example 1, in an amount of $10^{-3}$ mol per mol of silver in the emulsion. Each emulsion thus obtained was coated on a polyethylene terephthalate film support in an amount of 4 g Ag/m$^2$.

Thereafter, each coated sample was exposed to light and measured for the optical density according to the procedures in Example 1.

The results are given in Table 2.

TABLE 2

| Sample No. | Ammine Complex Salt Added before Coating ($10^{-3}$ mol/mol Ag) | Relative Sensitivity | Toe Gradient Value (a) | Toe Gradient Value (b) | Relative Evaluation Value of Toe Gradient (c) | $D_{max}$ | Remarks |
|---|---|---|---|---|---|---|---|
| 6 | None | 100 | −0.49 | 3.09 | 100 | 4.15 | Control |
| 7 | $[Ni(NH_3)_6]Cl_2.\frac{1}{2}H_2O$ | 95 | −0.45 | 2.82 | 110 | 4.35 | Invention |
| 8 | $[Cr(NH_3)_5(H_2O)](NO_3)_3$ | 100 | −0.40 | 2.51 | 123 | 4.25 | Invention |
| 9 | $[Cr(NH_3)_5Cl]Cl_2$ | 112 | −0.40 | 2.51 | 123 | 4.10 | Invention |
| 10 | $[Ru(NH_3)_6]Cl_3$ | 125 | −0.45 | 2.82 | 110 | 4.35 | Invention |
| 11 | $Na_2[PdCl_4]$ | 95 | −0.49 | 3.09 | 100 | 4.00 | Comparison |

Note:
Relative Evaluation Value of Toe Gradient: Reciprocal of each toe gradient value (b) and shown as a relative value using value (c) of No. 6 as 100. The greater values indicate a better toe gradient.

From the results of Table 2, it is evident that the ammine complex salts according to the present invention achieve a desirable improvement in the toe gradient, whereas $Na_2[PdCl_4]$, described in the prior art Japanese Patent Application (OPI) No. 6918/74, has no such effect.

While the invention has been described in detail and with reference to specific embodiments thereof, it will be apparent to one skilled in the art that various changes and modifications can be made therein without departing from the spirit and scope thereof.

What is claimed is:

1. A direct positive type silver halide photosensitive material for obtaining a high contrast image in the highlight portions thereof, said image comprised substantially of only silver prepared by:

(a) chemically fogging silver halide grains, and (b) subsequent to said fogging, adding at least one metal ammine complex salt in an amount of $10^{-5}$ to $10^{-2}$ mol per mol of silver wherein the metal component is selected from the group consisting of cobalt, nickel, ruthenium and chromium.

2. A direct positive type silver halide photosensitive material according to claim 1, wherein the metal of the metal ammine complex salt is selected from the group consisting of $Co^{3+}$, $Cr^{3+}$, $Ni^{2+}$, and $Ru^{3+}$.

3. A direct positive type silver halide photosensitive material according to claim 1, wherein the metal ammine complex salt comprises from 4 to 6 ammine groups.

4. A direct positive type silver halide photosensitive material according to claim 1, 2, or 3, wherein said material does not contain a compound which will form a color dye image.

5. A direct positive type silver halide photosensitive material according to claim 1, 2, or 3, in which the metal ammine complex salt is a cobalt ammine complex salt.

6. A direct positive type silver halide photosensitive material according to claim 1, 2, or 3, including a sensitizing organic dye consisting of an electron acceptor having an $E_{red}$ of at least $-0.1$.

7. A direct positive type silver halide photosensitive material according to claim 6, in which the sensitizing organic dye is at least one member selected from the dyes of the formulae (I), (II), (III), (IV), (V) and (VI):

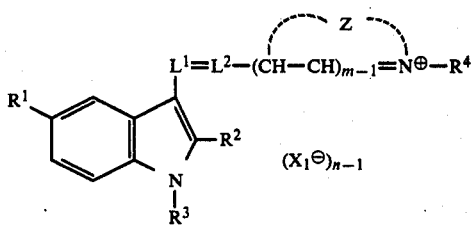

(I)

wherein $R^1$ represents a hydrogen atom or a nitro group; $R^2$ is selected from a hydrogen atom, lower alkyl groups, a chlorine atom, a carboxyl group, lower alkoxycarbonyl groups and aryl groups; $R^3$ is selected from a hydrogen atom, alkyl groups, substituted alkyl groups and aryl groups; $R^4$ is selected from alkyl groups, substituted alkyl groups and aryl groups; $L^1$ and $L^2$ each represents a methine chain or $L^2$ and $R^4$ together can form a polymethine chain; $X_1$ represents an anion; m and n each represents 1 or 2; and Z represents an atomic group forming a 5-membered or 6-membered heterocyclic nucleus;

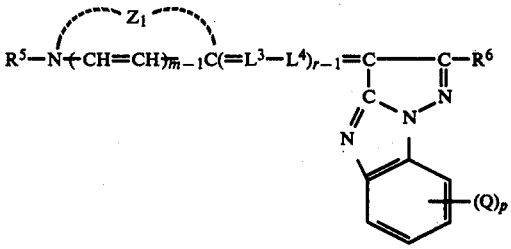

(II)

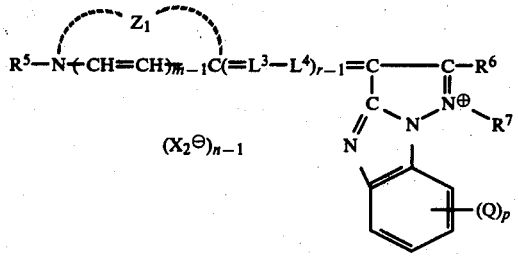

(III)

wherein in formulae (II) and (III) m represents 1 or 2; n represents 1 or 2; r represents 1, 2 or 3; p represents 1, 2, 3 or 4; $L^3$ and $L^4$ each represents a methine chain, or $L_3$ and $R^5$ can together form a polymethylene chain; $R^5$ and $R^7$ are each selected from alkyl groups, substituted alkyl groups and a vinylmethyl group; $R^6$ represents a substituent common in the pyrazolo[1,5-a]benzimidazole compounds, such as a hydrogen atom, an alkyl group, a carboxyl group, an alkoxycarbonyl group, an amino group, an acylamino group, an aryl group, and an acid amino group; $Z^1$ represents an atomic group forming a 5-membered or 6-membered heterocyclic nucleus and is the same as Z in formula (I); Q represents a known substituent in pyrazolo[1,5-a]benzimidazole compounds, such as a halogen atom, a lower alkyl group, an aryl group, a carboxyl group, an alkoxycarbonyl group, or an acylamino group; and $X_2$ represents an anion as defined for $X_1$;

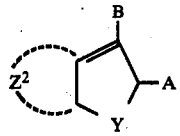

(IV)

wherein $Z^2$ represents an atomic group forming a cycloheptatriene ring; Y represents an oxygen atom, —NH— or —N=; A represents =O, a halogen atom or a pyridinium group; and B represents a hydrogen atom or an alkoxycarbonyl group, or

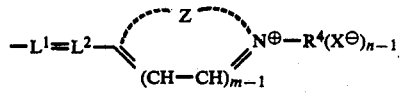

wherein $L^1$, $L^2$, Z, $R^4$, n, m and $X_1$ are as defined in the formula (I);

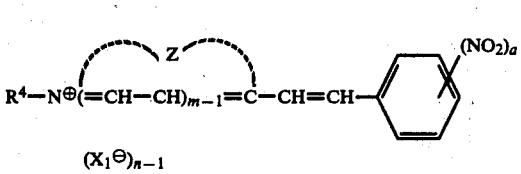

(V)

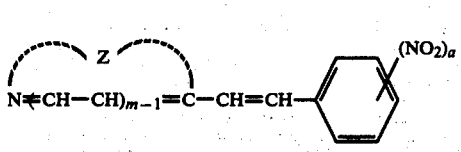

(VI)

wherein Z, $R^4$, m, n and $X_1$ are as defined in formula (I), and a represents 1 or 2.

8. A direct positive type silver halide photosensitive material according to claim 1, wherein the amount of said metal ammine complex salt is $10^{-4}$ to $10^{-3}$ mol per mol of silver.

9. A direct positive type silver halide photosensitive material as in claim 1, 2, or 3, wherein the particle size of the silver halide comprising the photosensitive material is from 0.04 to 2.0μ in diameter.

10. A direct positive type silver halide photosensitive material as in claim 9, wherein the particle size of the silver halide comprising the photosensitive material is from 0.15 to 0.70μ in diameter.

11. A direct positive type silver halide photosensitive material according to claim 7, wherein the sensitizing organic dye is present in an amount from about $1\times10^{-6}$ to $5\times10^{-3}$ mol per mol of silver halide.

12. A process for preparing a direct positive type silver halide emulsion for obtaining a high contrast image in the highlight portions thereof, said image comprised substantially of only silver comprising:

(1) chemically fogging silver halide grains containing at least 40 mol% silver chloride;

(2) adsorbing a sensitizing organic dye onto the surfaces of the chemically fogged grains; and (3) subsequent to said fogging step, adding at least one member selected from the group consisting of metal ammine complex salts of cobalt, nickel, ruthenium and chromium in an amount of $10^{-5}$ to $10^{-2}$ mol per mole of silver halide.

13. A process for preparing a direct positive type silver halide emulsion as in claim 12, wherein the metal of the metal ammine complex salt is selected from the group consisting of $Co^{3+}$, $Cr^{3+}$, $Ni^{2+}$, and $Ru^{3+}$.

14. A process for preparing a direct positive type silver halide emulsion as in claim 12, wherein the metal ammine complex salt comprises from 4 to 6 ammine groups.

15. A process as claimed in any of claim 12 or 13, wherein said metal ammine complex salt is a cobalt amine complex salt.

16. A process for preparing a direct positive type silver halide emulsion according to claim 12, wherein the metal ammine complex salt is added in an amount of $10^{-4}$ to $10^{-3}$ mol per mol of silver.

17. A process for forming a silver image of high contrast in the highlight portions thereof, comprising:

preparing a high contrast, chemically fogged direct positive type silver halide photosensitive material by chemically fogging silver halide grains and subsequent to said fogging, adding at least one metal ammine complex salt in an amount of $10^{-5}$ to $10^{-2}$ mol per mol of silver selected from the group consisting of cobalt, nickel, lithium, and chromium; and imagewise exposing said high contrast, chemically fogged direct positive type silver halide photosensitive material; and developing said material to form a silver image said image being comprised substantially of only silver.

* * * * *